US012538983B2

(12) United States Patent
Hehenwarter

(10) Patent No.: US 12,538,983 B2
(45) Date of Patent: Feb. 3, 2026

(54) ROLLABLE PIECE OF FURNITURE

(71) Applicant: ALAN LAMONT, Steinberg (DE)

(72) Inventor: Tobias Hehenwarter, Munich (DE)

(73) Assignee: ALAN LAMONT, Steinberg (DE)

( * ) Notice: Subject to any disclaimer, the term of this patent is extended or adjusted under 35 U.S.C. 154(b) by 253 days.

(21) Appl. No.: 18/564,288

(22) PCT Filed: Sep. 21, 2021

(86) PCT No.: PCT/EP2021/075982
§ 371 (c)(1),
(2) Date: Nov. 27, 2023

(87) PCT Pub. No.: WO2022/248072
PCT Pub. Date: Dec. 1, 2022

(65) Prior Publication Data

US 2024/0245221 A1 Jul. 25, 2024

(30) Foreign Application Priority Data

May 28, 2021 (DE) ..... 10 2021 205 487.0

(51) Int. Cl.
*A47C 7/02* (2006.01)
*A47C 13/00* (2006.01)

(52) U.S. Cl.
CPC ..... *A47C 13/00* (2013.01)

(58) Field of Classification Search
CPC ..... A47C 13/00; A47C 1/143; A47C 31/126
See application file for complete search history.

(56) References Cited

U.S. PATENT DOCUMENTS 3,877,750 A * 4/1975 Scholpp ..... A47C 1/143 297/284.3
3,912,408 A * 10/1975 Domnick ..... H02G 9/025 404/35
5,157,804 A * 10/1992 Williams ..... A47L 23/26 52/177
5,282,692 A * 2/1994 McLeod ..... E01C 9/086 428/33
6,877,816 B1 * 4/2005 Farmont ..... A47C 31/126 297/380
7,344,197 B2 3/2008 Sanderson
(Continued)

FOREIGN PATENT DOCUMENTS

CN 101380171 A 3/2009

OTHER PUBLICATIONS

International Search Report for PCT/EP2021/075982, dated Mar. 2, 2022.

*Primary Examiner* — Shin H Kim
(74) *Attorney, Agent, or Firm* — Sughrue Mion, PLLC

(57) ABSTRACT

The invention relates to a rollable piece of furniture comprising:

a plurality of surface elements arranged next to one another, which are flexibly connected to one another in such a way that the piece of furniture can be transferred from a rolled up state to an unrolled state in relation to a rolling axis, wherein, in the unrolled state, the surface elements adjoin each other at least partially with their respective side surfaces and are bent in relation to the rolling axis and have a non-rectilinear course in such a way that the side surfaces are exposed to pressure when the piece of furniture is loaded as intended.

14 Claims, 12 Drawing Sheets

(56) References Cited

U.S. PATENT DOCUMENTS

| | | | | |
|---|---|---|---|---|
| D723,818 | S * | 3/2015 | Cleveland | D6/355 |
| 11,820,258 | B2 * | 11/2023 | Bahr | A47C 3/021 |
| 2024/0245221 | A1 * | 7/2024 | Hehenwarter | A47C 13/00 |

* cited by examiner

ROLLABLE PIECE OF FURNITURE

CROSS REFERENCE TO RELATED APPLICATIONS

This application is a National Stage of International Application No. PCT/EP2021/075982 filed Sep. 21, 2021, claiming priority based on Germany Patent Application No. 10 2021 205 487.0 filed May 28, 2021.

The invention relates to a rollable piece of furniture, in particular a rollable chair or table.

Patent document U.S. Pat. No. 7,344,197 B2 shows a chair that can be rolled up for storage or portability. The supporting structure of the chair is formed by two chain-shaped connecting elements, on which slatted elements are arranged at certain distances from each other and form the surface of the chair.

Absorption of the forces and stabilization of the chair is carried out only by the chain-shaped elements, each of those having a corresponding structure. In order to be able to absorb the forces exerted on the chair by a person, for example, the chain-shaped elements are each made to be solid, heavy and stable. This significantly increases the volume and weight of the chair, which has a negative impact on portability and storage.

Against this background, it is an object of the present invention to create a rollable piece of furniture having a simpler design, in particular with regard to force absorption and stability.

At least it is an object of the invention to create an alternative, rollable piece of furniture.

These object(s) are achieved by a rollable piece of furniture according to patent claim 1. Preferred embodiments are subject-matters of the dependent claims.

The rollable piece of furniture according to the invention comprises:

- a plurality of surface elements arranged next to one another, which are flexibly connected to one another in such a way that the piece of furniture can be transferred from a rolled up state to an unrolled state in relation to a rolling axis, wherein,
- in the unrolled state, the surface elements adjoin each other at least partially with their respective side surfaces and are bent in relation to the rolling axis and have a non-rectilinear course in such a way that the side surfaces are exposed to pressure when the piece of furniture is loaded as intended.

The piece of furniture according to the invention is in particular a chair or a table.

The surface elements arranged next to one another are preferably connected to each other flexibly/rotatably via connecting elements and together form a surface of the piece of furniture in the unrolled state.

The flexible connection of the surface elements makes it possible to transfer the piece of furniture from the unrolled state, in which the piece of furniture fulfills its intended function, to the rolled up state, in which the piece of furniture has a smaller volume and offers corresponding advantages in terms of transport and storage.

Different shapes of the piece of furniture according to the invention can be formed and defined by individually designing the surface elements arranged next to one another.

Due to the curved and non-rectilinear shape of the surface elements arranged next to one another, compressive forces act in the areas of the side surfaces through which the surface elements adjoin against one another in the unrolled state and are transmitted accordingly. This means that the surface elements themselves have a stabilizing effect and the compressive force is not transmitted only via the connecting elements that flexibly/rotatably connect the surface elements.

Preferably, the surface elements each have a longitudinal axis extending along the direction of the rolling axis, and

- a height, which defines a distance between the side surfaces of the respective surface element, of such surface elements of the plurality of surface elements, which in the unrolled state are located in the region of a curvature of a shape of the piece of furniture, changes preferable along the longitudinal axis.

The longitudinal axes of the surface elements preferably run/extend parallel to each other and parallel to the rolling axis.

The curvature of the shape of the piece of furniture is determined in particular by the individual design of the surface elements arranged next to one another. In the area of the curvature, the height of the surface elements at a central portion, for example, is minimum or maximum, depending on which direction of curvature the curvature has and how strong the curvature is.

The surface elements preferably each have a longitudinal axis extending along the direction of the rolling axis, wherein the surface elements are shaped preferable in such a way that a distance between a surface facing the rolling axis, which connects the side surfaces of the respective surface element with each other, and the rolling axis at end portions along the longitudinal axis is different/varies.

The aforementioned surface is, in particular, the surface of the surface elements which, together with the other surface elements, forms the front surface or the back surface of the piece of furniture in the unrolled state.

The distance between the surface and the rolling axis can change continuously, i.e. the corresponding surface elements can be curved as a whole. Alternatively, the distance can only vary in certain regions, i.e. the corresponding surface elements are only curved in certain regions, for example. The distance to the rolling axis is maximal in the center portion of the surface elements, particularly. In other words, the surface of the surface elements facing the rolling axis is concave.

In this configuration, the surface elements have particularly good stabilizing properties, which improve the more the distance to the rolling axis varies along the corresponding longitudinal axis.

Preferably, all or only some of the surface elements of the plurality of surface elements are curved, not rectilinear and have the concave surface facing the rolling axis.

The side surfaces of the flexibly connected surface elements preferably adjoin flat against each other and preferably have the same surface area.

This results in a good load distribution over the entire surface area of the side surfaces.

The surface elements are preferably flexibly connected to each other by connecting elements, which are exposed to tension when the piece of furniture is loaded as intended.

The connecting elements are preferably a plurality of links which are flexibly connected to each other by rotatable joints, wherein the connecting elements are each attached to an associated surface element. The connecting elements together therefore form a chain in particular.

The rotatable joints preferably make it possible to transfer the piece of furniture according to the invention from the unrolled to the rolled up state. The rotatable joints have axes of rotation that preferably run parallel to the rolling axis.

Preferably, the connecting elements are attached to the surface of the piece of furniture facing the rolling axis.

The distance between the surface facing the rolling axis and the rolling axis is preferably smaller at end portions at ends of the respective surface elements lying in the direction of the longitudinal axis than at a center portion located between the ends lying in the direction of the longitudinal axis.

The resulting non-rectilinear course of the surface elements in the direction of their longitudinal axis can be, for example, a curved course, a kinked course or a U-shaped course. The curved shape improves the (pressure) force absorption of the piece of furniture in particular. Furthermore, stiffening structures, such as beads, ribs and/or recesses, can preferably be provided to the surface elements.

The shape of the piece of furniture in the unrolled state preferably corresponds a to a chair at least comprising the following regions:

- a base region in which or over which the chair contacts a ground surface,
- a load region, which is arranged above the support region and in/on which the intended load is applied to the chair, and
- a support region connecting the base region and the load region.

The base region, the load region and the support region are preferably each made up of a plurality of surface elements.

The base region, the load region and the support region preferably shape the chair in such a way that it has the functional principle of a cantilever chair. This means that the support region is the only, exclusive connection between the base region and the load region and is preferably located on the side of the chair facing the lower legs of a person sitting on the chair.

The load region defines in particular a seat surface of the chair that comes into contact with the buttocks of the person sitting on the chair.

In the unrolled state, the surface elements arranged next to one another preferably form a continuous, flush surface of the aforementioned regions.

Despite the lack of rear legs, the stability of this chair construction is ensured by the fact that a force applied to the load region by a person's buttocks, for example, is redirected to the support region or to the base region, and the force flow does not run exclusively via the connecting elements, but also via the side surfaces of the surface elements. In particular, the connecting elements are subjected to tensile stress and the side surfaces of the surface elements to compressive stress. The base region, which preferably extends to a back end of the chair, preferably forms a wide floor support surface and prevents the chair from tipping over backwards.

The shape of the piece of furniture in the unrolled state preferably describes an arc in the support region, in that the height at the end portions at the ends of the respective surface elements lying in the direction of the longitudinal axis is greater than the height at the center portion, which is arranged between the ends lying in the direction of the longitudinal axis.

The height is preferably minimum at the center portion and maximum at the end portions. Depending on how much the height at the end portions varies from the height at the center portion, the amount of curvature of the arch can be changed.

The shape of the piece of furniture in the unrolled state preferably corresponds to a chair further comprising the following regions:

- a backrest region that supports a back of a person sitting on the load region and extends vertically to the load region, and
- a further support region connecting the load region and the backrest region.

In this context the shape of the piece of furniture in the unrolled state preferably describes an arc in the further support region, in that the height at the end portions at the ends of the respective surface elements lying in the direction of the longitudinal axis is smaller than the height at the center portion, which is arranged between the ends lying in the direction of the longitudinal axis.

The height is preferably maximum at the center portion and minimum at the end portions. Depending on how much the height at the end portions varies from the height at the center portion, the amount of curvature of the arch forming the further support region can be changed.

The shape of the piece of furniture in the unrolled state preferably corresponds to a table comprising the following regions:

- a load region, in which the intended load is applied to the table and which defines a deposit surface of the table,
- a plurality of side regions that support the load region against a ground surface, and
- a plurality of transition regions connecting the load region with the plurality of side regions.

The surface elements are preferably shaped in such a way that the distance between the surface facing the rolling axis and the rolling axis is constant in a central section, which lies between the ends of the respective surface elements lying in the direction of the longitudinal axis, and the central section forms the parking surface on a side facing away from the rolling axis.

Preferably the surface elements are stabilized in the unrolled state by a tension belt running along the central portions in such a way that the piece of furniture retains the shape of the piece of furniture (table or chair) in the unrolled state in an unloaded state.

Preferably the tension belt runs in passages, which are formed in the respective surface elements, in such a way that it is not visible from the outside when the piece of furniture is the unrolled state.

Below, a preferred embodiment of the rollable piece of furniture according to the invention is explained with reference to the attached figures.

FIRST EMBODIMENT—CHAIR

Figure 1:
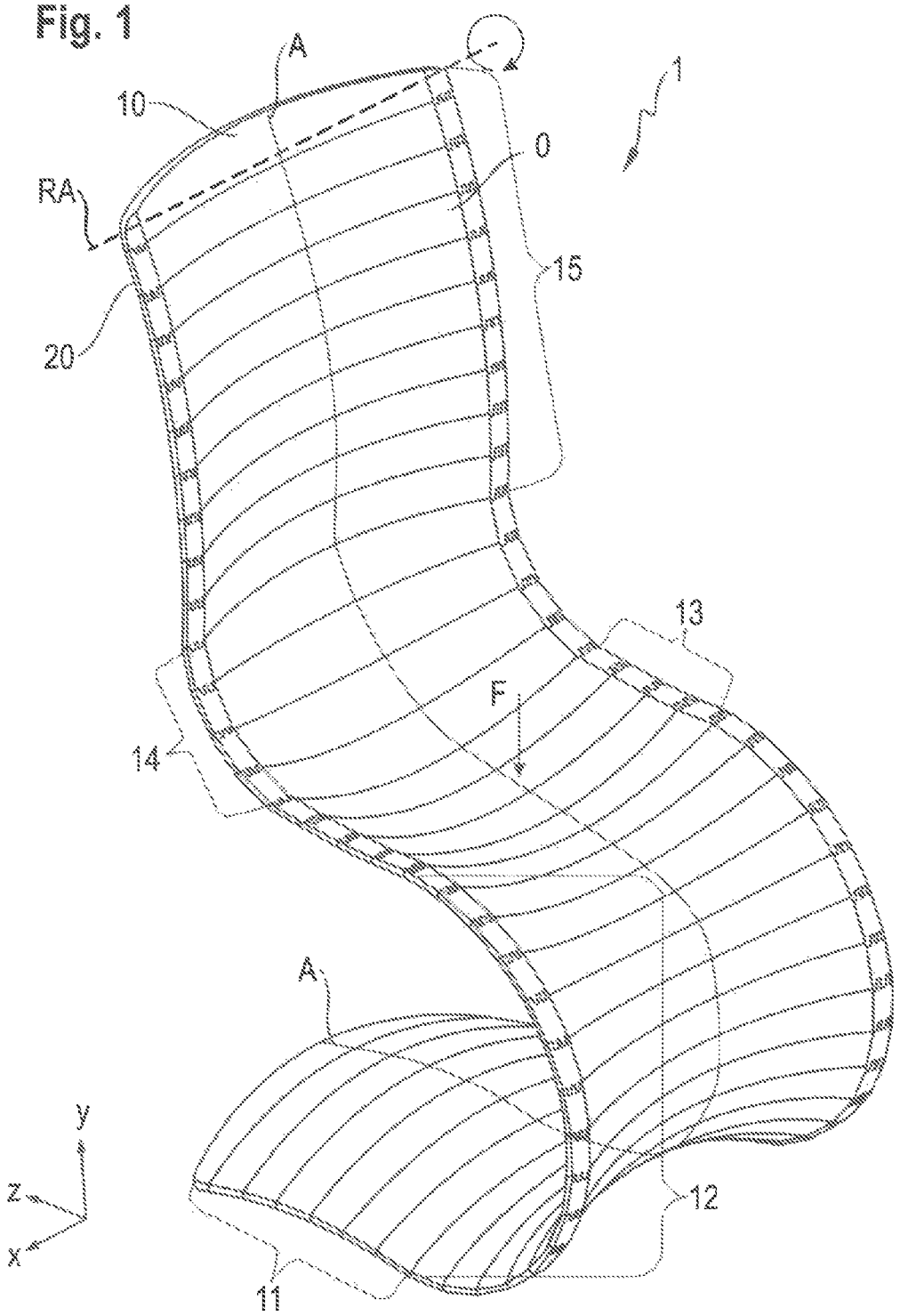
FIG. 1 shows a perspective view of a rollable piece of furniture, in particular a chair, according to a first embodiment of the invention, wherein the piece of furniture is in the unrolled state.
Figure 2:
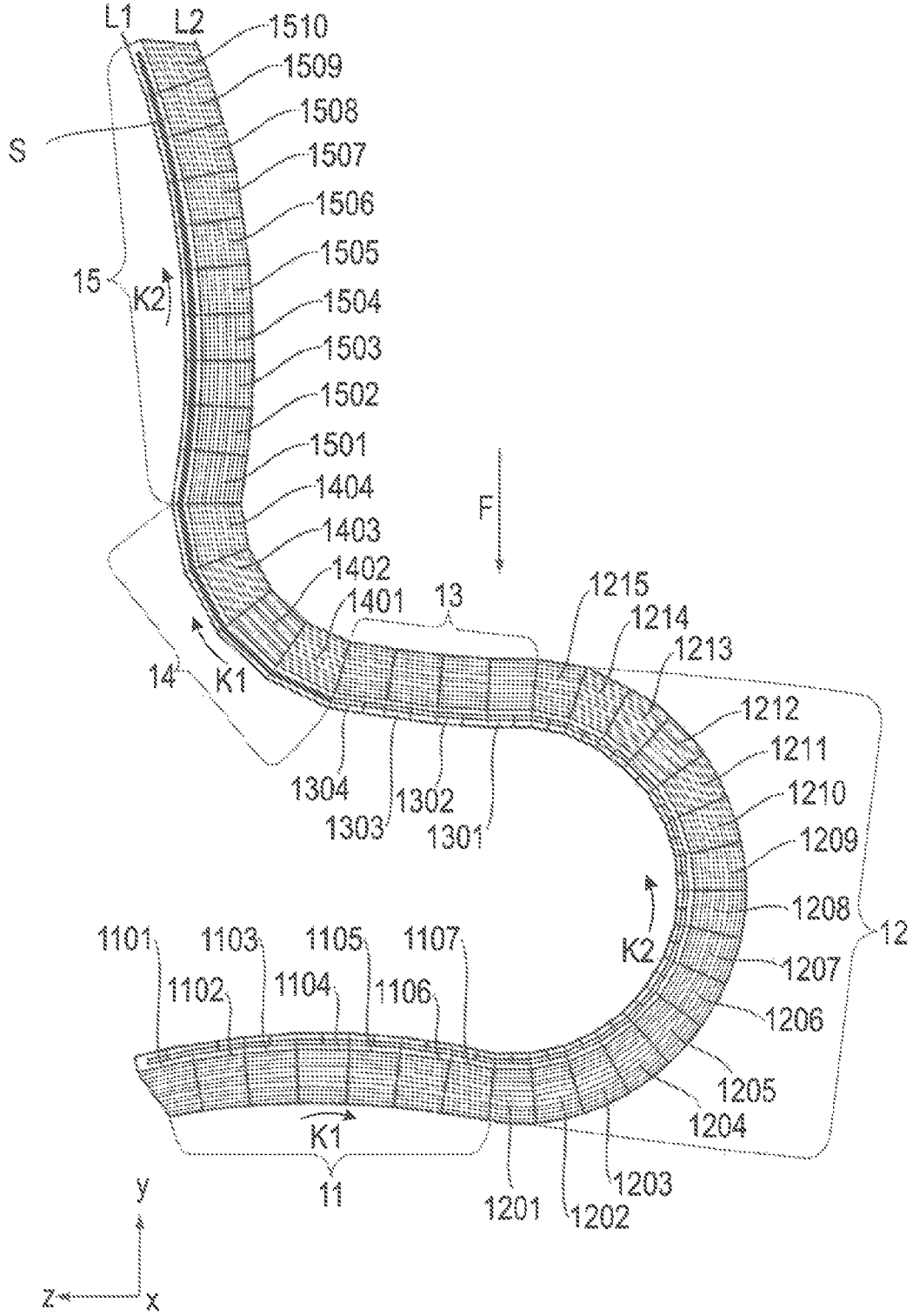
FIG. 2 shows a longitudinal section of the rollable piece of furniture along a line A-A from FIG. 1, with the piece of furniture in the unrolled state.

FIGS. 1 and 2 show a rollable piece of furniture 1 according to a first embodiment of the invention. In the figures, the piece of furniture 1 is in an unrolled state and is a chair on which a human person can sit.

FIG. 1 shows a perspective view of the chair and FIG. 2 a corresponding longitudinal section along a line A-A shown in FIG. 1.

The chair 1 comprises a plurality of surface elements 10 arranged next to one another. In the first embodiment shown, the chair 1 comprises, for example, thirty-six such surface elements 10 arranged next to one another.

Connecting elements 20 connect the surface elements 10 flexibly/rotatably to one another on each side of the chair 1 lying in the X direction, in order to enable the chair 1 to be rolled up about a rolling axis RA shown in FIG. 1, as explained below. The connecting elements 20 are connected on each side of the chair 1 in the form of a chain.

The chair shown in FIGS. 1 and 2 has at least a base region 11, a load region 13 and a support region 12 connecting said regions 11, 13 with each other.

Seven of the surface elements 10 form the base region 11, wherein the corresponding surface elements are indicated by the reference signs 1101 to 1107 in FIG. 2. The base region 11 forms a lower region of the chair 1 and touches a ground surface or floor on which the chair 1 stands.

The support region 12 comprises fifteen surface elements 10 arranged next to one another indicated by reference signs 1201 to 1215 in FIG. 2. The support region 12 preferably extends in a region between the knees and the soles of the feet of a person sitting on the chair 1. The support region 12 connects the load region 13 and the base region 11.

The load region 13 forming the seat surface comprises four surface elements arranged next to one another indicated by reference signs 1301 to 1304 in FIG. 2. The load region 13 is the region that serves as a seat surface for the buttocks of the person sitting on it when the chair 1 is used as intended.

Furthermore, the chair 1 can preferably comprise a backrest region 15 and a further support region 14 connecting the backrest region 15 with the load region 13.

The backrest region 15 comprises ten surface elements 10 arranged next to one another with the corresponding reference numbers 1501 to 1510 used in FIG. 2. The backrest region 15 corresponds to a region against which a person sitting on the chair 1 can lean.

Like the load region 13, the further support region 14 actually comprises four surface elements arranged next to one another, which are indicated by reference numbers 1401 to 1404 in FIG. 2. The further support region 14 connects the backrest region 15 with the load region 13 in such a way that the backrest region 15 runs/extends essentially vertically (Y-direction) to the load region 13.

The individual regions described above can be subdivided more finely or coarsely in other ways. The invention and also the embodiment are not limited to the above-mentioned numbers of surface elements 10.

In the sectional view shown in FIG. 2, the base region 11 has a slightly curved course with a first direction of curvature K1, which corresponds to a right-hand curvature in relation to the section shown.

The transition to the support region 12 describes a turning point. In the subsequent course, the support region 12 follows a semi-circular course, which has a second direction of curvature K2 opposite to the first direction of curvature K1. The second direction of curvature K2 is a left-hand curvature in the section shown.

The load region 13 adjoins the support region 12 with an almost straight line describing a turning point and merges into the further support region 14.

The further support region 14 describes a curved quarter-circle-like course, which in turn has the first direction of curvature K1.

The transition into the backrest region 15 actually describes another turning point and therefore has the second direction of curvature K2 again.

The above-mentioned and explained region form the chair 1 shown in FIGS. 1 and 2, which uses the shape and functional principle of a cantilever chair. In the unrolled state, the surface elements 10 arranged next to on another form a continuous surface facing the rolling axis RA.

Despite the lack of rear legs, the stability of this chair construction is ensured by the fact that a weight force F exerted by a person sitting on the chair 1, which acts for example onto the load region 13 or the corresponding seat surface, is transferred to the base region 11 via the support region 12. The base region 11 extending to a rear end of the chair 1 forms a wide floor support surface and prevents the chair 1 from tipping over backwards.

The connecting elements 20 are connected on each side of the chair 1 lying in the X direction and form the two chains already mentioned. Each of the chains comprises thirty-six connecting elements 20, each of which is flexibly connected to one another by rotatable joints.

Preferably, the connecting elements 20 are attached to a front surface, i.e. to the surface of the chair 1 facing the rolling axis RA. The front surface A is the surface that a person sitting on chair 1 touches.

The connecting elements 20 are preferably attached to the surface elements 10 using screw connections. The corresponding screws are inserted from a back surface of the chair 1 into passages formed in the surface elements 10 and screwed into corresponding internal threads of the respective surface elements 20. Other forms of connection, such as gluing or riveting, are also conceivable.

Preferably, materials with a high tensile strength are used for the connecting elements 20. Examples of such materials are steel or titanium.

The described courses of the regions 11 to 15 of the chair 1 are realized by the individual design of the surface elements 10 arranged next to one another, which will be discussed below.

Figure 3:
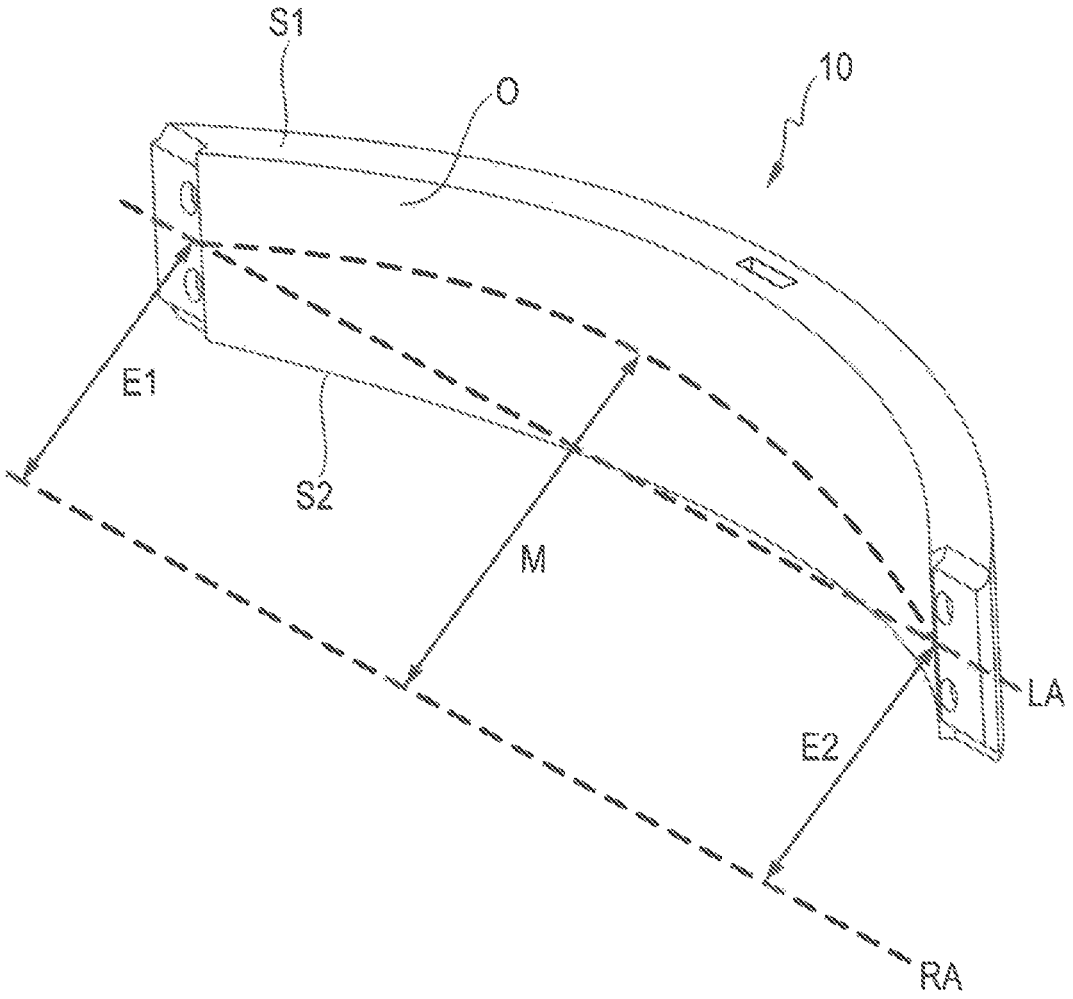
FIG. 3 shows a perspective view of a surface element of a plurality of surface elements that make up the piece of furniture shown in FIG. 1.

FIG. 3 shows a perspective view of one of the surface elements 10 shown in FIGS. 1 and 2.

The surface element 10 shown extends along a longitudinal axis LA extending along the direction of the rolling axis RA. The surface element 10 has a non-rectilinear course in this direction, which is expressed in the fact that a distance between the surface O, which faces the rolling axis RA, and the rolling axis RA is smaller at end portions E1 and E2 lying in the direction of the longitudinal axis LA than at a center portion M, which is located in the middle between the ends lying in the direction of the longitudinal axis LA.

As an alternative to the continuously curved course shown, the surface element 10 can also have a kinked or U-shaped course, for example.

As can be seen from FIGS. 1 and 2, all surface elements 10 of chair 1 have a non-rectilinear, curved shape. The invention is not limited to this. It is possible that only those surface elements 10 of one of the regions 11 to 15 have such a non-rectilinear, curved shape. In particular, it is preferred that the surface elements 10, which are located in the support region 12 and/or the further support region 14, have this non-rectilinear, curved shape.

The surface elements 10 shown in FIGS. 1 and 2 each have side surfaces that adjoin against each other when the chair 1 is unrolled. These side surfaces of the surface element 10 shown in FIG. 3 are indicated by the reference signs S1 and S2.

Figure 4A:
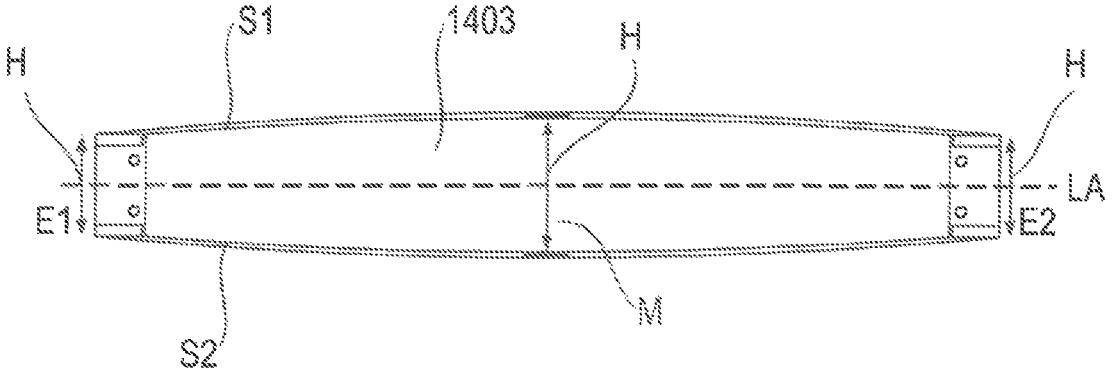
FIGS. 4A to 4C show three differently designed surface elements in a top view of a surface facing the rolling axis.
Figure 4B:
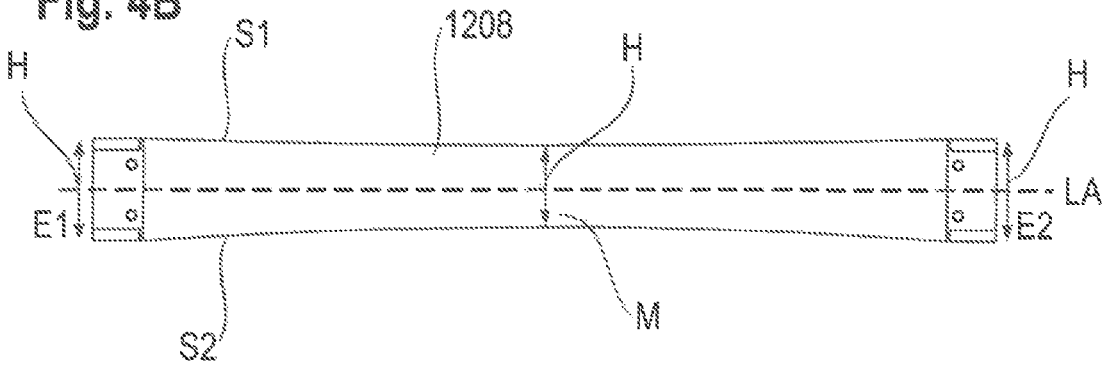
Figure 4C:
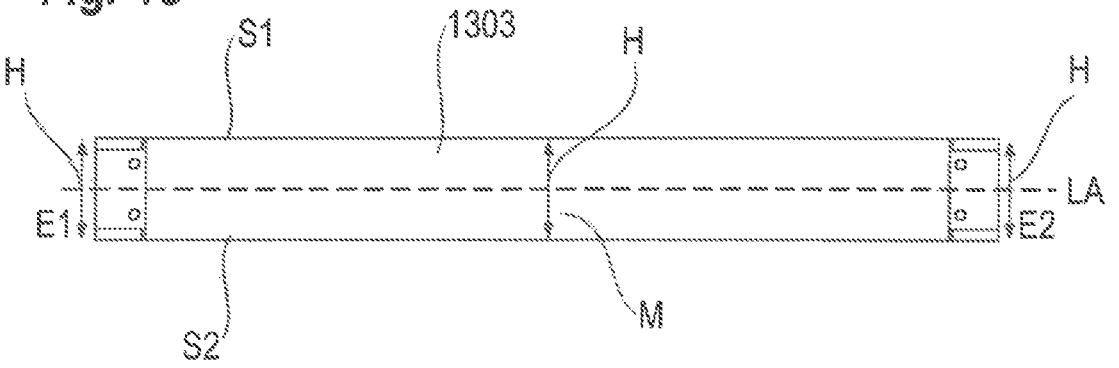

FIGS. 4A to 4C show three differently designed surface elements in a plan view of the front surface O, which, as intended, faces the rolling axis RA.

FIG. 4A shows the surface element 1403 of the further support region 14, which follows the first direction of curvature K1. The surface element 1403 has the non-rectilinear, curved course in the direction of its longitudinal axis LA, as explained with reference to FIG. 3, as can be seen in FIGS. 1 and 2. A height H of the surface element 1403 is smaller at the end portions E1 and E2 than the height at the center portion M. The side surfaces of the surface element 1403, with which it adjoins against adjacent surface elements 10 in the unrolled state of the chair 1, are provided with the corresponding reference signs S1 and S2.

FIG. 4B shows the surface element 1208 of the support region 12, which follows the second direction of curvature K2. The surface element 1208 also has the non-rectilinear, curved course in the direction of its longitudinal axis LA, as explained with reference to FIG. 3, as can be seen in FIGS. 1 and 2. The height of the surface element 1208 at the end portion E1 and E2 is greater than the height at the center portion M. The side surfaces of the surface element 1208, with which it adjoins against adjacent surface elements 10 when the chair 1 is unrolled, are provided with the corresponding reference signs S1 and S2.

FIG. 4C shows the surface element 1303 of the load region 13, which describes the essentially straight course shown in FIG. 2. The surface element 1303 also has the non-rectilinear, curved course in the direction of its longitudinal axis LA, as explained with reference to FIG. 3, as can be seen in FIGS. 1 and 2. The height of the surface element 1303 at the end portions E1 and E2 is equal to the height at the center portion M. The side surfaces of the surface element 1303, with which it adjoins against adjacent surface elements 10 when the chair 1 is unrolled, are provided with the corresponding reference signs S1 and S2.

Lines L1 and L2 are shown in the sectional view in FIG. 2.

The line L1 runs along the center portions M of the surface elements 10 arranged next to one another. Line L2, on the other hand, runs along the end portions E1 of the surface elements 10 arranged next to one another or along the chains.

Due to the non-rectilinear course along their longitudinal axes LA of all surface elements 10 arranged next to one another, the lines L1 and L2 have an offset, wherein the line L2 is closer to the rolling axis RA.

The weight force F, which is applied to the load region 13 by a person, for example, causes the side surfaces S1 and S2 facing each other of surface elements arranged next to one another to be loaded/stressed in compression along the line L1. Conversely, this also means that the surface elements 10 along line L2 exert tensile stress on the connecting elements 20 or the chains. The further apart the lines L1 and L2 are or the more pronounced the curved, non-rectilinear course of the surface elements 10, the smaller the compressive and tensile forces (compressive and tensile loads). Preferably the lines L1 and L2 have a distance from each other of 60 cm, 70 cm, 80 cm or 90 cm.

Preferably, the first side surfaces S1 and the second side surfaces S2 of adjacent surface elements 10 are in full contact with one another and preferably have the same surface area. This is achieved by adapting the first side surfaces S1 and the second side surfaces S2 of adjacent surface elements 10 under certain circumstances to be correspondingly inclined to one another.

It is preferable for the side surfaces S1 and S2 of the surface elements 10 to lie flat on top of each other, as compressive loads that occur as a result of the applied weight F are distributed over a larger area.

The non-rectilinear, curved course of the surface elements 10 along their longitudinal axes LA, as described with reference to FIG. 3, is decisive for the stability of the chair 1, in particular the offset of the lines L1 and L2, which results from the described individual design of the surface elements arranged next to one another. As a result, the compressive forces are preferably transmitted to areas of the side surfaces S1 and S2 in the area of the center portion M, which is preferably in the middle, while the tensile forces are transmitted to the connecting elements 20 arranged at the end portions E1 and E2.

In other words, the force flow and the force absorption do not take place exclusively via the connecting elements 20, but the surface elements 10 are also involved.

However, the curved, stave-shaped or meniscus-like shape of the surface elements 10 also has the advantage that it achieves an ergonomic effect, preferably in the load region 13, which accommodates the buttocks of a seated person, and in the backrest region 15, which supports the back of the seated person.

Preferably, materials that are lightweight, have good resistance to pressure and good rigidity are used for the surface elements 10 arranged next to one another. Examples of such materials are wood, polymers, fiber composites and light metals. However, the surface elements 10 are not limited to the aforementioned materials.

Furthermore, reinforcing cores can be provided in or onto the surface elements 10 arranged next to one another, which in particular have a beneficial effect on the load-bearing capacity of the surface elements 10 under pressure.

The reinforcement cores are preferably used in regions that are exposed to high pressure loads. In the first embodiment, such regions correspond to the base region 11, the support region 12 and the load region 13, which are essentially exposed to the weight of the person (cantilever).

However, it is also conceivable to provide reinforcement cores in other regions.

To accommodate or fasten the reinforcing cores, pockets can be provided in the surface elements 10 arranged next to one another, which preferably accommodate the reinforcing cores in a form-fitting manner.

The reinforcing cores are preferably attached to or in the surface elements 10 arranged next to one another using screw connections.

The chair 1 can also preferably have at least one tension belt further stabilizing the structure of the chair when unrolled and preferably ensures that the chair 1 retains its shape when unrolled and unloaded. The tension belt S is shown in FIG. 2.

The tension belt S preferably comprises a fixing device that enables one end of the tension belt to be fastened to a predetermined point on the chair 1 when it is unrolled and released again for rolling in.

In the first embodiment, the tension belt preferably extends over the backrest region 15, the further support region 14 and the load region 13.

Preferably, passages are provided in the surface elements 10 arranged next to one another, which pass through the corresponding surface elements 10 from the respective side surface S1 to its side surface S2 in the manner of a shaft.

The tension belt S extends through these passages and is not visible to an observer from the outside.

In the first embodiment, the passages are preferably provided in the adjacent surface elements 10 of the backrest region 15 and the further support region 14. In the load region 13, the tension belt S runs on the back surface and can be manually released there for the rolling-in process described below.

The tension belt S is preferably permanently attached (not manually releasable) to the end surface element 1510 of the backrest region 15.

This means that the tension belt is preferably manually releasable at one end and fixed and non-releasable at the other.

Preferred materials for the tension belt S are those that are lightweight and have a high tensile strength or toughness.

Furthermore, the chair 1 can have cover caps which cover the holes and screw heads of the screws used to fasten the connecting elements 20 and/or the reinforcing cores in the surface elements 10 arranged next to one another.

The cover caps are preferably made of the same material as the corresponding elements.

The flexible/rotatable connection of the surface elements 10 arranged next to one another, realized by the connecting elements 20 or chains, makes it possible to transfer the piece of furniture 1, in particular the chair, from the unrolled state shown, in which the chair 1 fulfils its intended function, to a rolled up state, in which it has a smaller volume and offers corresponding advantages in terms of transport or storage.

In the first embodiment shown in FIGS. 1 and 2, the start of the rolling-in process is indicated at the end surface element 1510 of the backrest region 15. However, rolling in can also begin at the end surface element 1101 of the support region 11, for example.

The rotatable joints of the chains allow them to be rolled up.

Figure 5:
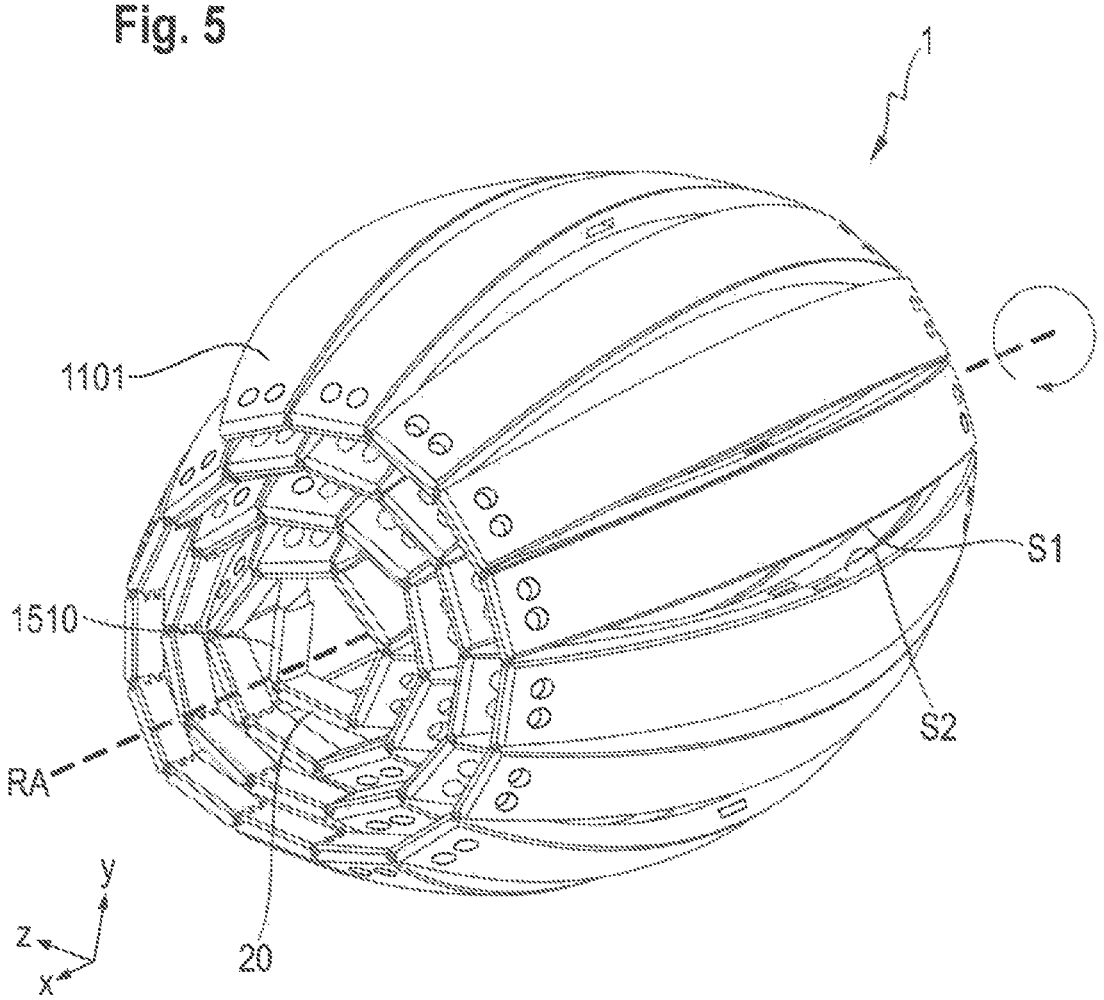
FIG. 5 shows a perspective view of a rollable piece of furniture according to the first embodiment of the invention in the rolled up state.
Figure 6:
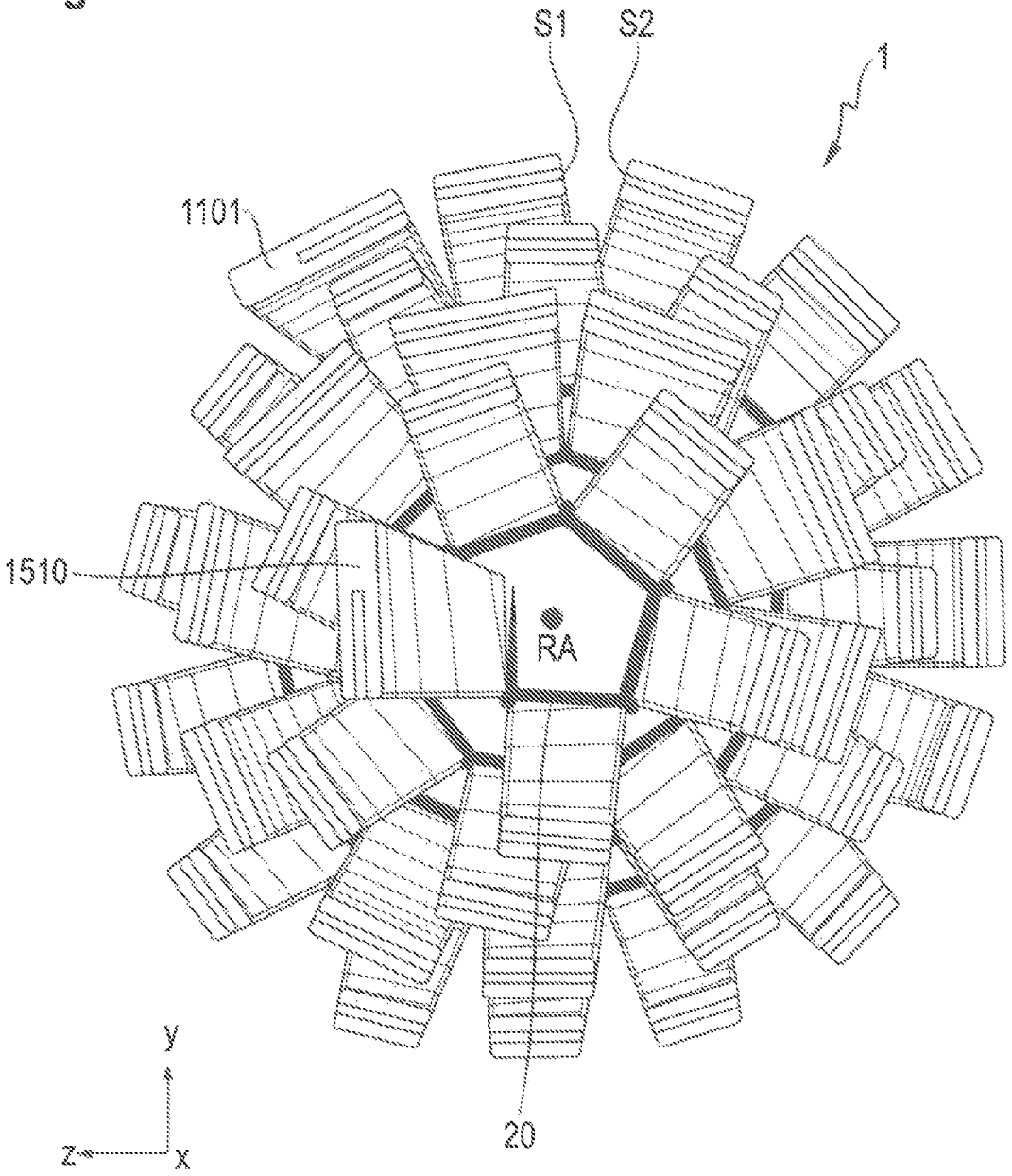
FIG. 6 shows a longitudinal section along line A-A from FIG. 1 of the rollable piece of furniture according to the first embodiment of the invention in the rolled up state.

FIG. 5 shows a perspective view of the rollable chair 1 according to the first embodiment of the invention in the rolled up state and FIG. 6 shows a corresponding longitudinal section along line A-A from FIG. 1.

In the rolled up state, the chair 1 has a barrel-like, bulbous shape due to the curved shape of the surface elements 10 along the longitudinal axis LA.

The chair 1 is rolled up by rotating the rotatable joints of the connecting elements 20. As a result of the rotation, gaps/protrusions form between the first side surface S1 and the second side surface S2 of adjacent surface elements.

In FIG. 5, the rolling-up process was started at the end surface element 1510 of the backrest region 15. Accordingly, the surface element 1510 of the backrest region is in a central position in relation to the rolling axis RA.

The other surface elements 10 arranged next to one another run in a spiral around the rolling axis RA. The end surface element 1101 of the base region 11 is therefore furthest away from the rolling axis RA.

Alternatively, the rolling-in process can be started at the end surface element 1101 of the support base 11. Accordingly, the surface element 1101 of the base region 11 would be in the central position in relation to the rolling axis RA.

SECOND EMBODIMENT—TABLE

Figure 7:
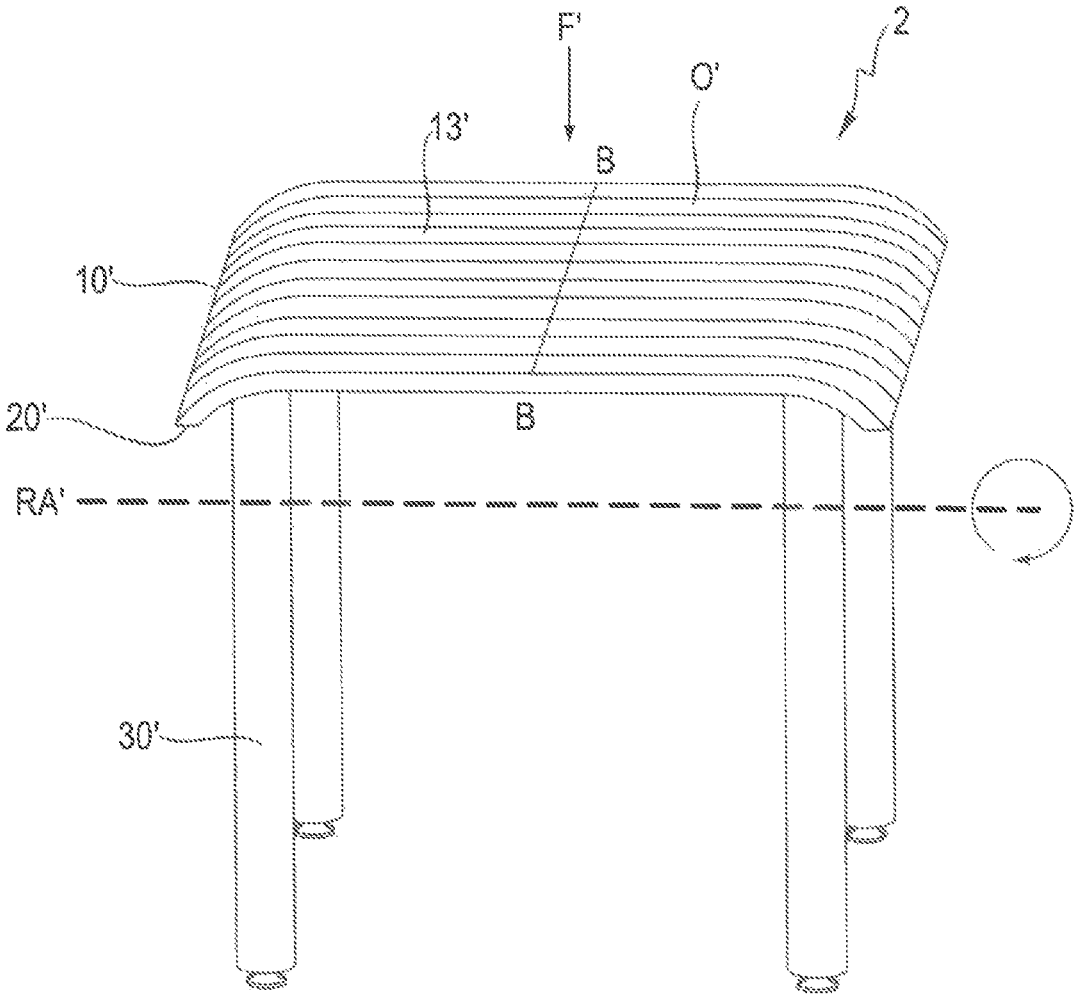
FIG. 7 shows a perspective view of a rollable piece of furniture, in particular a table, according to a second embodiment of the invention in the unrolled state.
Figure 8:
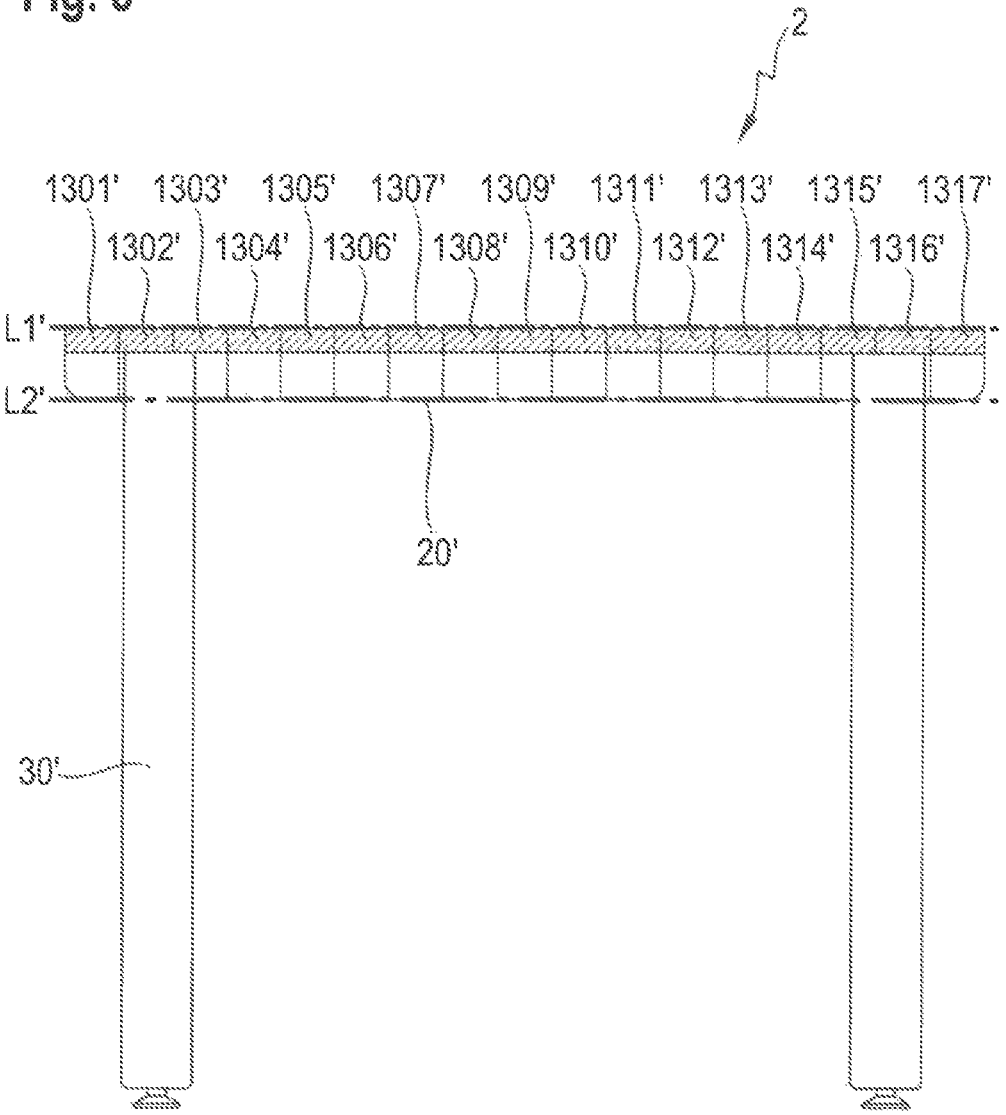
FIG. 8 shows a longitudinal section of the table along a line B-B from FIG. 7 of the rollable piece of furniture according to the second embodiment of the invention in the unrolled state.

FIG. 7 shows a perspective view of a rollable piece of furniture 2 according to a second embodiment of the invention. The piece of furniture 2 is in an unrolled state and forms a table. FIG. 8 shows a corresponding longitudinal section along line B-B from FIG. 7.

The table 2 preferably comprises a plurality of surface elements 10' arranged next to one another, which are flexibly connected to each other on each side via connecting elements 20'. As in the first embodiment, the connecting elements 20' are interconnected and form a respective chain on each side. With regard to the structure and fastening of the chains, reference is made to the explanations in the context of the first embodiment.

As already explained in the first embodiment of the invention, functional regions of the piece of furniture or table 2 can be shaped and defined as a result of the individual design of the surface elements 10' arranged next to one another. In the second embodiment shown in FIGS. 7 and 8, the table 2 has a load region 13' that defines deposit surface/top surface O' on which objects can be placed as intended.

The plurality of surface elements 10' forms the aforementioned load region 13'. FIG. 7 shows the table 2 in a variant with eleven surface elements 10' and FIG. 8 in a variant with seventeen surface elements 10' (1301' to 1317'). The load region 13' can preferably be finer or coarser.

Furthermore, the table 2 preferably has table legs 30', which are attached to the load region 13' in the unrolled state. For this purpose, fastening means are provided on the corresponding surface elements 10', which make it possible to release the table legs 30' from the load region 13' defining the deposit surface in order to transfer the table 2 from the unrolled state to the rolled up state. Examples of fastening means are screw connections or snap-in connections. In the variant shown in FIG. 8, the table legs 30' are connected to the surface elements 1302' and 1303' as well as 1315' and 1316' arranged next to one another.

Figure 9:
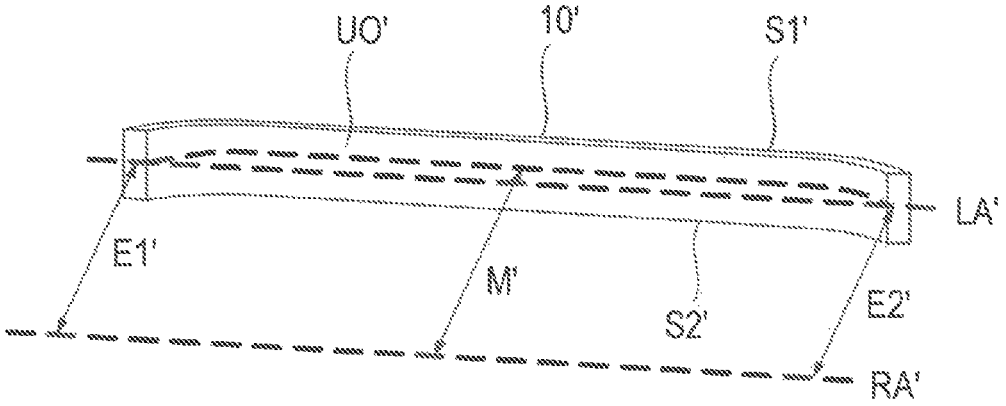
FIG. 9 shows a perspective view of a surface element of the table.

FIG. 9 shows a perspective view of one of the surface elements 10' from FIG. 7 or 8. In FIGS. 7 and 8, the surface elements 10' forming the deposit surface are all identical in design—except for the end surface elements 1301' and 1317'.

The surface element 10' extends along a longitudinal axis LA', which points/runs in the direction of the rolling axis RA'.

In addition, the surface element 10' has a non-rectilinear course along the longitudinal axis LA'. That is, the surface element 10' is shaped such that a distance between a surface facing the rolling axis RA', which is an underside surface UO' of the loading region 13', and the rolling axis RA' at end portions E1' and E2' at ends lying in the direction of the longitudinal axis LA' is smaller than the distance at a center portion M', which is preferably located in a middle between the ends lying in the direction of the longitudinal axis LA'.

In the embodiment shown, the surface element 10' has a U-shaped course along the longitudinal axis LA', which is only curved at the end portions E1', E2'. The distance between the end portions is constant, so that the surface O' facing away from the rolling axis RA' forms the flat deposit surface.

In the unrolled state, the side surfaces S1' and S2' of the surface element 10' are in contact with corresponding side surfaces of adjacent surface elements 10'. Lines L1' and L2' are shown in the sectional view in FIG. 8. The line L1' runs along the center portions M of the surface elements 1301' to 1317' (10') arranged next to one another. The line L2', on the other hand, runs along the end portions E1' of the surface elements 1301' to 1317' arranged next to one another. Due to the non-rectilinear course along the longitudinal direction LA' of the surface elements 1301' to 1317', the lines L1' and L2' have an offset, wherein the line L2' is located closer to the rolling axis RA'.

When a force F' acts on the load region 13', the side surfaces S1', S2' of adjacent surface elements 10' are subjected to pressure or pressed against each other. The force F', which is applied for example by objects lying on the load region 13', causes the side surfaces facing each other of the surface elements arranged next to one another to be subjected to compression along line L1' and to apply a tensile load to the connecting elements 20' along line L2'.

As in the first embodiment, in the second embodiment the flow of force and the absorption of force do not occur exclusively via the connecting elements 20' or chains, but the surface elements 1301' to 1317' (10') are also involved in this.

Preferably, the first side surfaces S1' and the second side surfaces S2' of adjacent surface elements 1301' to 1317' are in full-surface contact with one another and preferably have the same surface area. Since in the second embodiment example there is a straight line in the load region 13', the first side surfaces S1' and the second side surfaces S2' are aligned parallel to each other.

It is preferable for the surface elements 1301' to 1317' to lie flat on top of each other, as compressive loads that occur as a result of the applied force F' are distributed over a larger area and have a beneficial effect on the stability of the table 2.

Preferably, materials that are lightweight, have good resistance to pressure and good rigidity are used for the side-by-side surface elements 10'. Examples of such materials are wood, polymers, fiber composites and light metals.

As in the first embodiment of the invention, reinforcing cores or tension belts can be provided to further stabilize and stiffen the table 2. Furthermore, cover caps as described in the previous embodiment may also be used.

Figure 10:
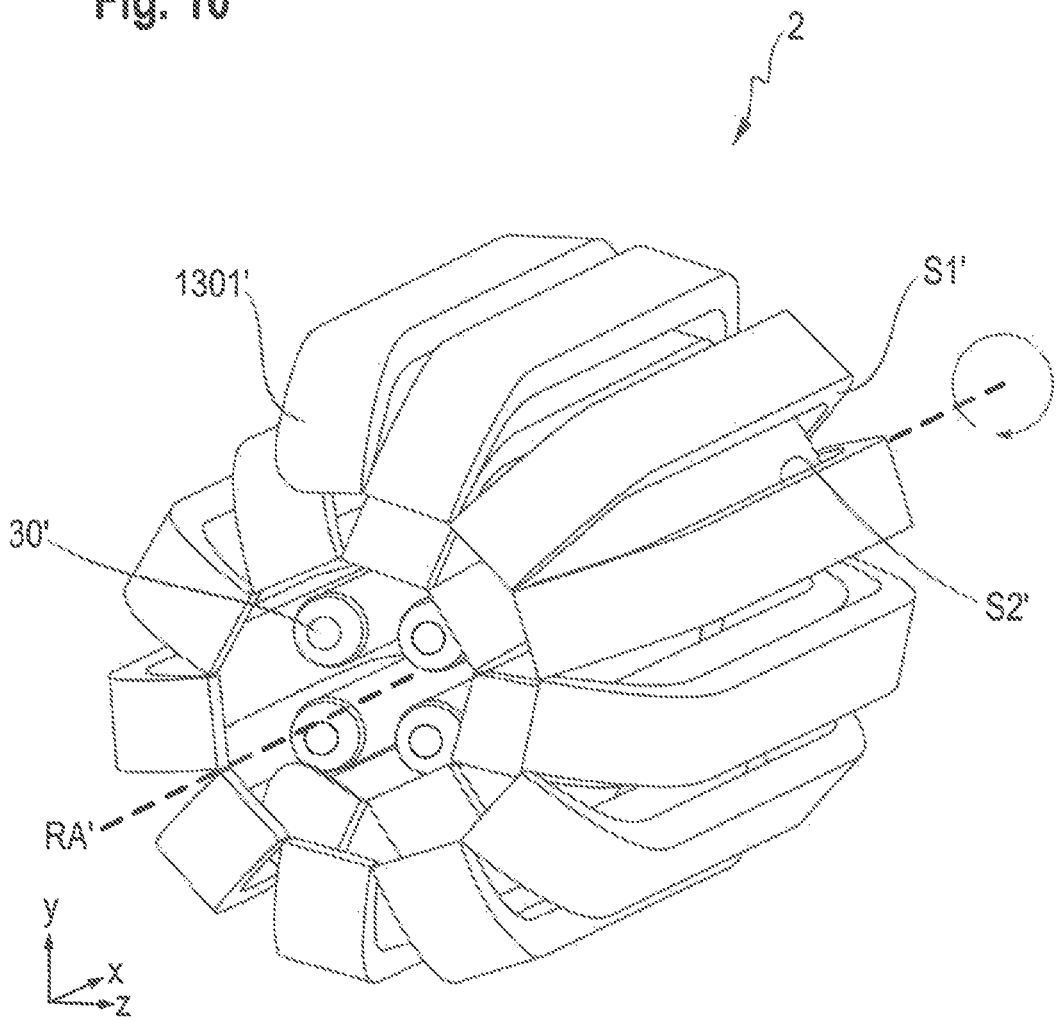
FIG. 10 shows a perspective view of a rollable piece of furniture according to the second embodiment of the invention in the rolled up state.
Figure 11:
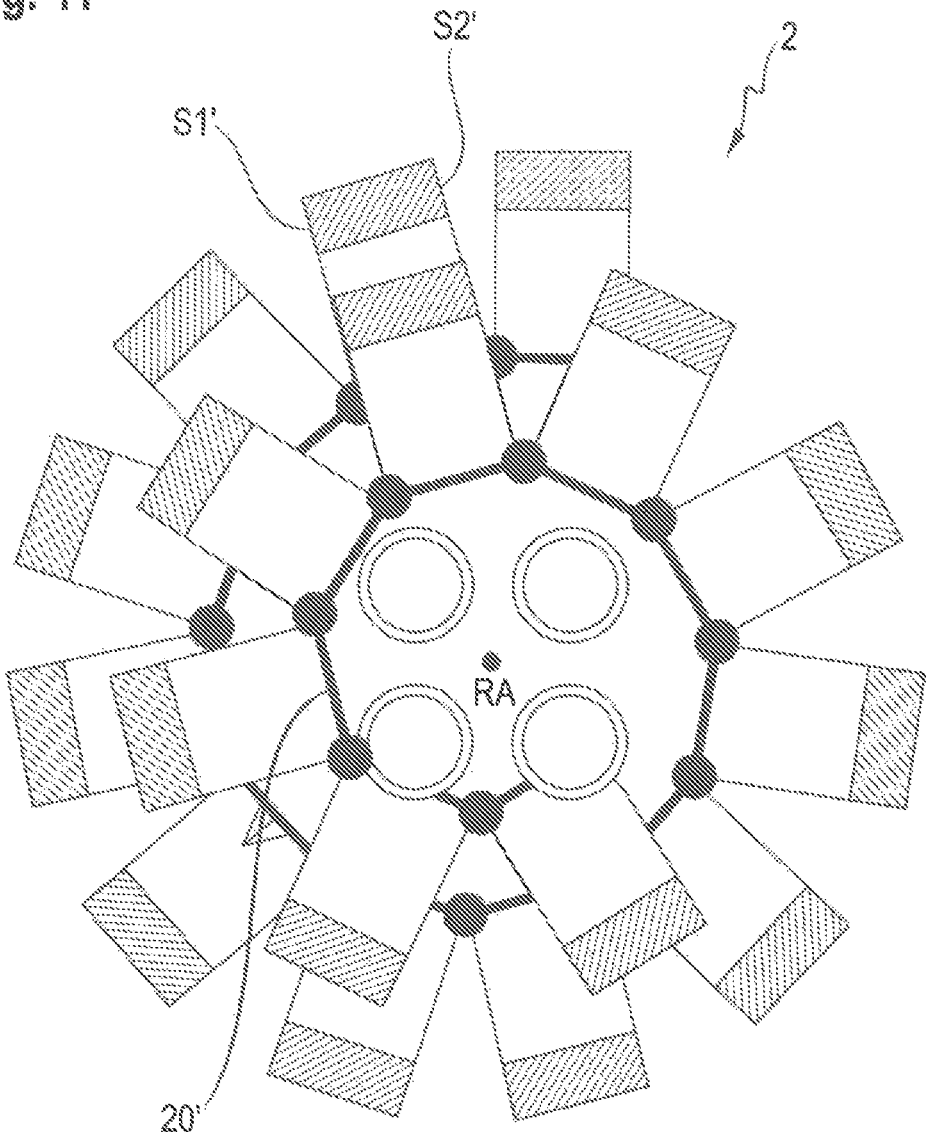
FIG. 11 shows a longitudinal section along line B-B from FIG. 7 of the rollable piece of furniture according to the second embodiment of the invention in the unrolled state.

FIG. 10 shows a perspective view of the table 2 in its rolled up state and FIG. 11 shows a corresponding longitudinal section along line B-B from FIG. 7.

In the rolled up state, the table 2 has a shape that resembles the shape of a barrel due to the non-rectilinear course of the surface elements 1301' to 1317' (10') along the longitudinal axis LA'.

The table 2 is rolled in by rotating the rotatable joints of the connecting elements 20'. This means that the load region 13' is rolled up.

In the second embodiment, the load region 13' can be rolled around the table legs 30'.

THIRD EMBODIMENT—TABLE

Figure 12:
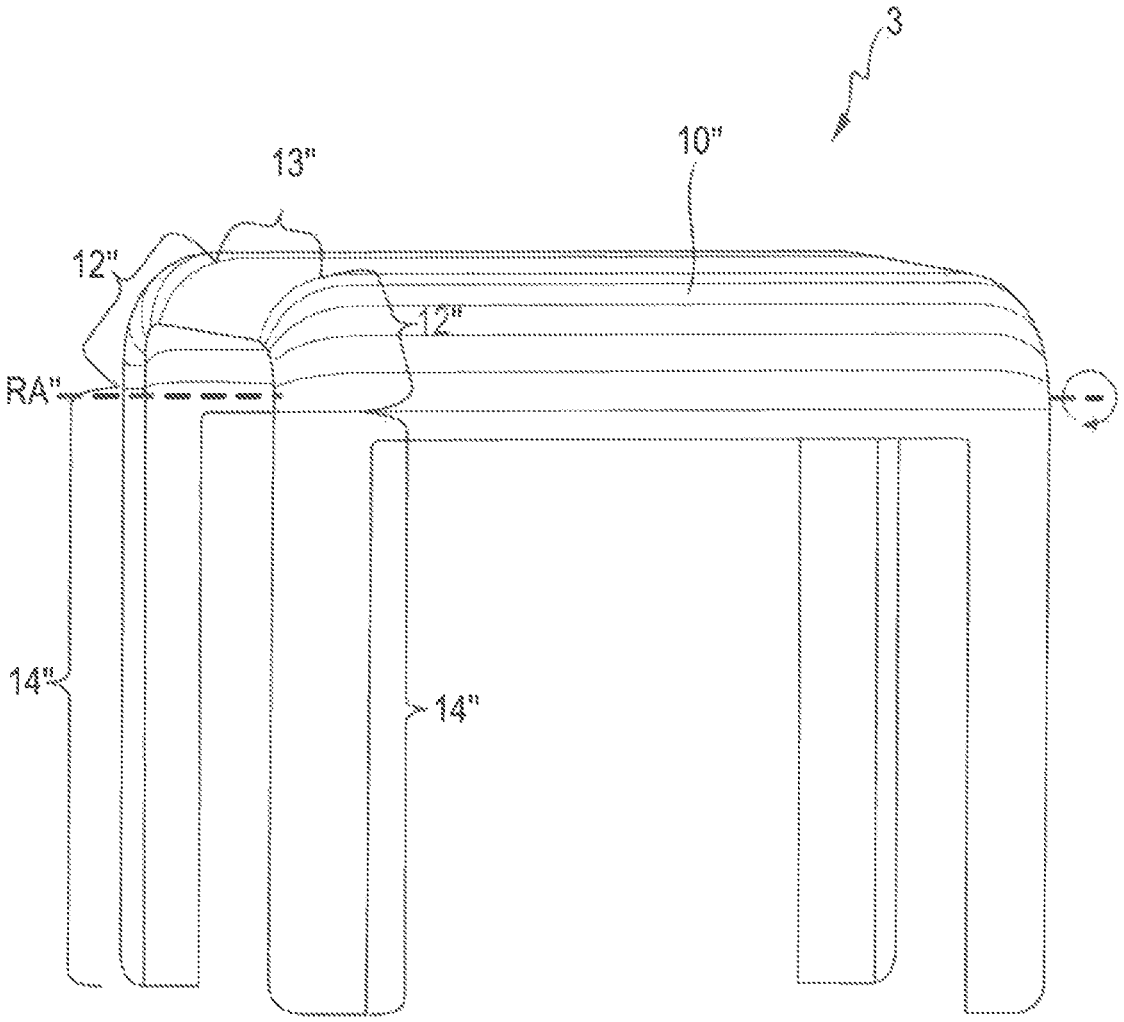
FIG. 12 shows a perspective view of a rollable piece of furniture, in particular a table, according to a third embodiment of the invention in the unrolled state.

FIG. 12 shows a perspective view of a rollable piece of furniture 3 according to a third embodiment of the invention in the unrolled state.

In the third embodiment shown, the piece of furniture 3 is also a table 3. In contrast to the second embodiment of the invention, the table legs 14" of the table 3 are also constructed using surface elements 10" arranged next to one another, which are flexibly/rotatably connected to one another via connecting elements. FIG. 12 does not show the subdivision of the table legs 14".

Comparable to the chair 1 of the first embodiment, the table 3 as a whole can be transferred from the unrolled state shown, in which the table 3 fulfills its intended function, to a rolled up state, in which the table has a smaller volume and offers corresponding advantages in terms of transport and storage.

As a result of the individual design of the surface elements 10" arranged next to one another, functional regions of the table 3 can in turn be shaped and defined. The table 3 comprises a load region 13", two support regions 12" and the table legs 14", which are connected to the support regions 12".

In the load region 13", the surface elements 10" are constructed as explained in the second embodiment, which is why reference is made to the corresponding explanations.

In the support regions, however, the surface elements 10" are constructed in the same way as in the other support region of the first embodiment, which is why reference is also made to the corresponding explanations in this regard.

The table 3 is rolled up around the rolling axis RA" shown.

In this third embodiment, too, the flow of force and the absorption of force in the unrolled state do not take place exclusively via the connecting elements 20, but the surface elements 10" are also involved.

The invention claimed is:

1. Rollable piece of furniture comprising:

a plurality of surface elements arranged next to one another, which are flexibly connected to one another in such a way that the piece of furniture can be transferred from a rolled up state to an unrolled state in relation to a rolling axis, wherein, in the unrolled state, the surface elements adjoin each other at least partially with their respective side surfaces and are bent in relation to the rolling axis and have a non-rectilinear course in such a way that the side surfaces are exposed to pressure when the piece of furniture is loaded as intended.

2. Rollable piece of furniture according to claim 1, wherein the surface elements each have a longitudinal axis extending along the direction of the rolling axis, and a height, which defines a distance between the side surfaces of the respective surface element, of surface elements of the plurality of surface elements, which in the unrolled state are located in the region of a curvature of a shape of the piece of furniture, changes along the longitudinal axis.

3. Rollable piece of furniture according to claim 1, wherein the surface elements each have a longitudinal axis extending along the direction of the rolling axis, and the surface elements are shaped in such a way that a distance between a surface facing the rolling axis, which connects the side surfaces of the respective surface element with each other, and the rolling axis at end portions along the longitudinal axis is different and varies.

4. Rollable piece of furniture according to claim 1, wherein the side surfaces of the flexibly connected surface elements adjoin flat against each other and preferably have the same surface area.

5. Rollable piece of furniture according to claim 1, wherein the surface elements are flexibly connected to each other by connecting elements, which are exposed to tension when the piece of furniture is loaded as intended.

6. Rollable piece of furniture according to claim 3, wherein the distance between the respective surface facing the rolling axis and the rolling axis is smaller at end portions at ends of the respective surface elements lying in the direction of the longitudinal axis than at a center portion located between the ends lying in the direction of the longitudinal axis.

7. Rollable piece of furniture according to claim 1, wherein the shape of the piece of furniture in the unrolled state corresponds to a chair comprising the following regions:

a base region in which the chair contacts a ground surface, a load region, which is arranged above the support region and in which the intended load is applied to the chair, and a support region connecting the base region and the load region.

8. Rollable piece of furniture according to claim 7, wherein the shape of the piece of furniture in the unrolled state describes an arc in the support region, in that the height at the end portions at the ends of the respective surface elements lying in the direction of the longitudinal axis is greater than the height at the center portion, which is located between the ends lying in the direction of the longitudinal axis.

9. Rollable piece of furniture according to claim 7, wherein the shape of the piece of furniture in the unrolled state corresponds to a chair further comprising the following regions:

a backrest region that supports a back of a person sitting on the load region and extends vertically to the load region, and a further support region connecting the load region and the backrest region.

10. Rollable piece of furniture according to claim 9, wherein the shape of the piece of furniture in the unrolled state describes an arc in the further support region, in that the height at the end portions at the ends of the respective surface elements lying in the direction of the longitudinal axis is smaller than the height at a center portion, which is arranged between the ends lying in the direction of the longitudinal axis.

11. Rollable piece of furniture according to claim 1, wherein the shape of the piece of furniture in the unrolled state corresponds to a table comprising the following regions:

a load region, in which the intended load is applied to the table and which defines a deposit surface of the table, a plurality of side regions that support the load region against a ground surface, and a plurality of transition regions connecting the load region with the plurality of side regions.

12. Rollable piece of furniture according to claim 11, wherein the surface elements are shaped in such a way that the distance between the surface elements and the rolling axis is constant in a central portion, which is located between the ends of the respective surface elements lying in the direction of the longitudinal axis and corresponds to the load region.

13. Rollable piece of furniture according to claim 1, wherein the surface elements are stabilized in the unrolled state by a tension belt in such a way that the piece of furniture retains the shape of the piece of furniture in the unrolled state in an unloaded state.

14. Rollable piece of furniture according to claim 13, wherein the tension belt runs in passages, which are formed in the respective surface elements, in such a way that it is not visible from the outside when the piece of furniture is the unrolled state.

* * * * *